US011598065B2

(12) United States Patent
Wang et al.

(10) Patent No.: US 11,598,065 B2
(45) Date of Patent: Mar. 7, 2023

(54) METHOD FOR STABILIZING AND LIFTING CHANNEL BOARDS BY UNDERWATER GROUTING

(71) Applicants: Zhengzhou University, Henan (CN); SAFEKEY Engineering Technology (Zhengzhou), Ltd., Henan (CN)

(72) Inventors: Fuming Wang, Henan (CN); Mingsheng Shi, Henan (CN); Chaojie Wang, Henan (CN); Chengchao Guo, Henan (CN); Peng Zhao, Henan (CN); Binghan Xue, Henan (CN); Yangyang Xia, Henan (CN); Yanjie Hao, Henan (CN); Xijun Zhang, Henan (CN); Xianfeng Zhao, Henan (CN); Yingli Wang, Henan (CN)

(73) Assignees: Zhengzhou University, Henan (CN); SAFEKEY Engineering Technology (Zhengzhou), Ltd., Henan (CN)

( * ) Notice: Subject to any disclaimer, the term of this patent is extended or adjusted under 35 U.S.C. 154(b) by 35 days.

(21) Appl. No.: 17/331,656

(22) Filed: May 27, 2021

(65) Prior Publication Data

US 2021/0285179 A1 Sep. 16, 2021

(30) Foreign Application Priority Data

May 30, 2020 (CN) ..... 202010479580.2

(51) Int. Cl.
*E02D 3/12* (2006.01)
*E02B 5/02* (2006.01)

(52) U.S. Cl.
CPC ..... *E02D 3/12* (2013.01); *E02B 5/02* (2013.01); *E02D 2250/003* (2013.01); *E02D 2300/002* (2013.01); *E02D 2300/0075* (2013.01)

(58) Field of Classification Search
CPC ..... E02D 3/12; E02D 2250/003; E02D 35/00; E01C 23/10; E04G 23/0203
See application file for complete search history.

(56) References Cited

U.S. PATENT DOCUMENTS 2,627,169 A * 2/1953 Poulter ..... E02D 35/00 405/267
4,567,708 A * 2/1986 Haekkinen ..... E01C 23/10 404/78

(Continued)

*Primary Examiner* — Benjamin F Fiorello

(57) ABSTRACT

A method for stabilizing and lifting a channel board by underwater grouting includes (A) when the channel board is damaged, removing the damaged channel board, cleaning and leveling a gravel layer under the damaged channel board, placing an undamaged channel board installed with first grouting pipes and a second grouting pipe on the gravel layer, wherein multiple geotextile bags are respectively bound to the first grouting pipes; when the channel board is subsided, installing first grouting pipes and a second grouting pipe into first grouting holes and a second grouting hole, respectively; (B) performing a first polymer grouting through the first grouting pipes, and performing a second polymer grouting through the second grouting pipe; (C) cutting off a part of the first grouting pipes the second grouting pipe which are exposed to the channel board, and leveling incisions; and (D) removing excess polymer left on the channel board.

17 Claims, 2 Drawing Sheets

(56) References Cited

U.S. PATENT DOCUMENTS 6,558,071 B1 * 5/2003 Sproules ..... E01C 23/10 404/78
6,976,804 B1 * 12/2005 Asplin ..... E01C 23/10 404/78
7,461,997 B1 * 12/2008 Mack, II ..... E01C 23/10 404/101
7,517,177 B2 * 4/2009 Erdemgil ..... E02D 27/34 405/266
7,789,591 B2 * 9/2010 Hakkinen ..... E02D 27/34 405/269
8,092,116 B1 * 1/2012 Asplin ..... E01C 23/10 404/78
8,186,907 B1 * 5/2012 Asplin ..... E01C 23/10 404/78
8,690,486 B2 * 4/2014 Barron ..... E02D 3/12 405/269
9,512,587 B2 * 12/2016 Arima ..... E02D 3/12
9,988,784 B2 * 6/2018 Barron ..... E02D 5/34
10,138,641 B2 * 11/2018 Tabatabai ..... E04G 23/0229
10,520,111 B2 * 12/2019 Taylor ..... F16L 55/18
10,760,236 B2 * 9/2020 Eddie ..... G01N 33/24
11,268,252 B2 * 3/2022 Pastor ..... E02D 3/12
2002/0098042 A1 * 7/2002 Canteri ..... E02D 3/12 405/40
2003/0053861 A1 * 3/2003 Smith ..... E01C 11/14 404/73
2003/0092787 A1 * 5/2003 Brown ..... E01C 23/10 521/130
2004/0247397 A1 * 12/2004 Fox ..... E02D 5/44 405/244
2008/0205995 A1 * 8/2008 Canteri ..... E21F 15/005 405/263
2009/0269146 A1 * 10/2009 Miljovski ..... E02D 5/54 405/233
2016/0305076 A1 * 10/2016 Doan ..... E04G 23/0203
2019/0323182 A1 * 10/2019 Matsudo ..... E01C 23/10
2021/0010223 A1 * 1/2021 Cui ..... E02D 35/005

* cited by examiner

METHOD FOR STABILIZING AND LIFTING CHANNEL BOARDS BY UNDERWATER GROUTING

CROSS REFERENCE OF RELATED APPLICATION

The present invention claims priority under 35 U.S.C. 119(a-d) to CN 202010479580.2, filed May 30, 2020.

BACKGROUND OF THE PRESENT INVENTION

Field of Invention

The present invention relates to the field of reinforcement and repair technology of channel boards in water conservancy project, and more particularly to a method for stabilizing and lifting a channel board by underwater grouting.

Description of Related Arts

With the continuous development of economic strength and technological level of China, the rational dispatch and improvement of water resources has become a major national strategy. Especially in recent years, with the operation of the Middle Route of the South-to-North Water Diversion Project and the intensification of urban river regulation in China, the protection of water supply canal has become particularly important. However, in the existing canals in operation, the most common disease is the subsidence and cracking of channel boards. Of course, as the first protective layer of the canal, the damage of channel boards also aggravates the erosion and seepage of the canal embankment by water, and causes major hazards such as instability of the canal slope or piping disaster after a long period of time. Therefore, it is very important to repair and treat channel boards. The conventional repair and treatment method is to replace damaged or subsided channel boards. However, when being replaced or repaired underwater, channel boards are difficult to be stabilized and lifted by traditional cement. After long-term scouring and erosion of water, the replaced and repaired channel boards will cause subsidence and damage, and the gravel and sand under the replaced and repaired channel boards will also be taken away by water, which seriously affects the safety of the canal.

SUMMARY OF THE PRESENT INVENTION

An object of the present invention is to provide a method for stabilizing and lifting a channel board by underwater grouting, which is able to realize the rapid repair and anti-seepage reinforcement of the channel board which is damaged or subsided underwater, and provide the technical guidance for safe operation of water supply canal.

Accordingly, to achieve the above object, the present invention provides technical solutions as follows.

A method for stabilizing and lifting a channel board by underwater grouting comprises the steps of:

(A) when the channel board is damaged, removing the damaged channel board, cleaning and leveling a gravel layer under the damaged channel board, placing an undamaged channel board installed with multiple first grouting pipes and at least one second grouting pipe on the gravel layer, wherein the multiple first grouting pipes are spacedly distributed at a periphery of the undamaged channel board; the at least one second grouting pipe is located at a middle portion of the undamaged channel board, multiple geotextile bags are bound to a lower portion of the multiple first grouting pipes, respectively;

when the channel board is subsided but is undamaged, installing multiple first grouting pipes and at least one second grouting pipe into multiple first grouting holes and at least one second grouting hole, respectively, wherein the first grouting holes and the at least one second grouting hole are reserved or drilled on site, the multiple first grouting holes are spacedly distributed at a periphery of the subsided channel board, the at least one second grouting hole is provided at a middle portion of the subsided channel board;

(B) performing a first polymer grouting through the multiple first grouting pipes, and then performing a second polymer grouting through the at least one second grouting pipe;

(C) cutting off a part of the multiple first grouting pipes and the at least one second grouting pipe which are exposed to the undamaged channel board or the subsided channel board with a pipe cutter, and leveling incisions; and (D) removing excess polymer left on the undamaged channel board or the subsided channel board.

Further, in the method for stabilizing and lifting the channel board by underwater grouting mentioned above, a length of each of the multiple geotextile bags is the same as a height of the damaged channel board or the subsided channel board needs to be lifted, the multiple geotextile bags are located between the gravel layer and the undamaged channel board.

Further, in the step (A) of the method for stabilizing and lifting the channel board by underwater grouting mentioned above, a canal structure where the undamaged channel board or the subsided channel board is located comprises canal embankment, sand cushion coated on the canal embankment, the gravel layer coated on the sand cushion and the undamaged channel board or the subsided channel board coated on the gravel layer in sequence, all of which are submerged in water.

Further, in the method for stabilizing and lifting the channel board by underwater grouting mentioned above, there are four first grouting holes in four corners of the undamaged channel board or the subsided channel board, respectively; there is one second grouting hole in the middle portion of the undamaged channel board or the subsided channel board.

Further, in the method for stabilizing and lifting the channel board by underwater grouting mentioned above, the first grouting pipes and the at least one second grouting pipe are stainless steel galvanized pipes.

Further, in the method for stabilizing and lifting the channel board by underwater grouting mentioned above, the first grouting pipes and the at least one second grouting pipe have a diameter of 5 mm.

Further, in the method for stabilizing and lifting the channel board by underwater grouting mentioned above, the polymer is a non-aqueous reactive polyurethane polymer.

Further, in the method for stabilizing and lifting the channel board by underwater grouting mentioned above, the geotextile bags are made of filament woven geotextiles.

Further, in the step (B) of the method for stabilizing and lifting the channel board by underwater grouting mentioned above, the first polymer grouting and the second polymer grouting are performed at a pressure in a range of 2 MPa and 5 MPa.

Further, in the step (B) of the method for stabilizing and lifting the channel board by underwater grouting mentioned above, when the channel board is subsided but is undamaged, it is necessary to observe while grouting, and grouting is stopped till a channel board that needs to be lifted is aligned with an adjacent channel board.

Beneficial effects of the method for stabilizing and lifting the channel board by underwater grouting provided by the present invention are as follows.

The method comprises injecting the polymer under the channel board and into the geotextile bags with the first grouting pipes and the at least one second grouting pipe. With the help of non-aqueous reaction, good fluidity, rapid expansion, high adhesion and other characteristics of the polymer, on the one hand, the polymer is able to quickly fill the geotextile bags for lifting the channel board in the presence of water, and to accurately lift the channel aboard through adjusting the length of each of the geotextile bags; on the other hand, water in the gravel layer under the channel board is quickly removed by using expansion reaction characteristics of the polymer, and then the gravel layer is effectively consolidated and lifted, and is bonded with the channel board, thus achieving the stabilization of the channel board after being quickly replaced and repaired in the presence of water. The method is able to prevent the seepage and reinforcement of the canal structure, and prevent the erosion of the gravel layer and sand cushion under the channel board by water, thereby preventing further subsidence of the channel board. Furthermore, the present invention is able to consolidate the channel board to prevent the channel board from loosening and sliding under the scouring of water. The method is fast, efficient and convenient, and uses the green, environmentally friendly and non-polluting grouting material. It overcomes the shortcoming that conventional methods are difficult to be constructed underwater, achieves rapid repair and anti-seepage reinforcement of the channel board which is damaged or subsided underwater, and provides the technical guidance for safe operation of channel board. At the same time, it uses the grouting pipes with the diameter of 5 mm, which basically does not damage the channel board and ensures the structural integrity of the original channel board.

Figure 1:
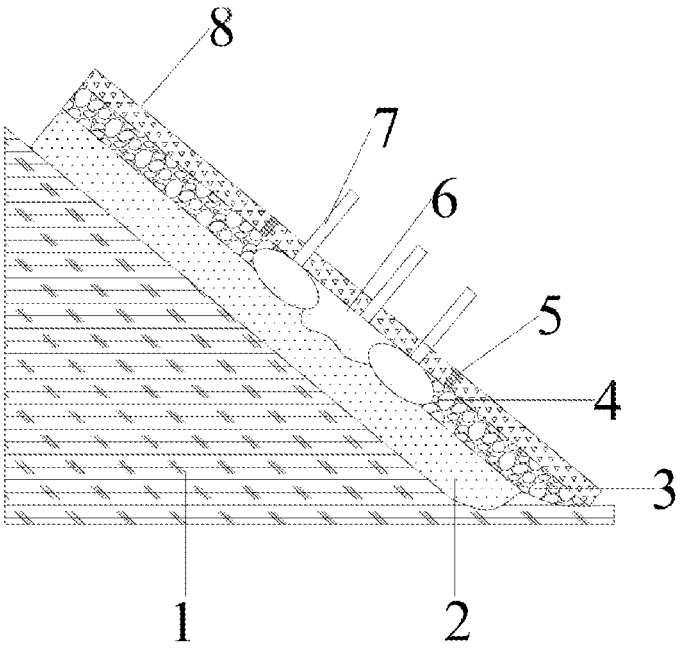
FIG. 1 is a structurally schematic view of a canal structure when a damaged channel board is replaced.

In the drawings, 1: canal embankment; 2: sand cushion; 3: gravel layer; 4: geotextile bag; 5: seam; 6: polymer; 7: first grouting pipe; 8: channel board; 9: first grouting hole; 10: second grouting pipe; 11: second grouting hole.

DETAILED DESCRIPTION OF THE PREFERRED EMBODIMENT

A method for stabilizing and lifting a channel board by underwater grouting according to a preferred embodiment of the present invention is further explained in detail with accompanying drawings as follows.

In the description of the present invention, it should be understood that the positions or positional relationships indicated by the terms, such as "upper", "lower", "front", "rear", "left", "right", "top", "bottom", "inner" and "outer", are based on the positions or positional relationships shown in the drawings, and are only for the convenience of describing the present invention and simplifying the description, rather than indicating or implying that the device or element referred to must have a specific orientation, be constructed and operated in a specific orientation, and therefore cannot be understood as a limitation of the present invention.

Figure 2:
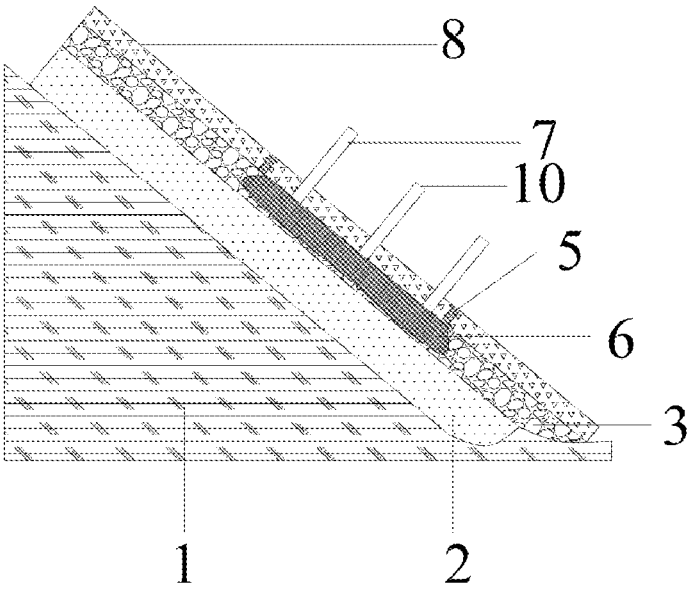
FIG. 2 is another structurally schematic view of a canal structure when a subsided channel board is lifted.
Figure 3:
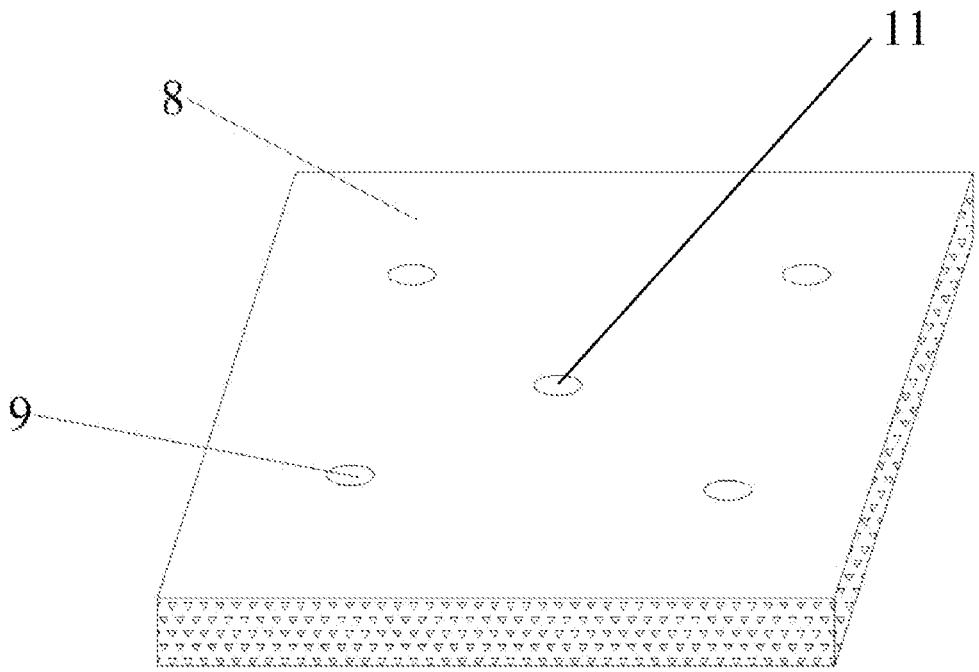
FIG. 3 shows the location distribution of grouting holes in the channel board.

Referring to FIGS. 1 to 3, a method for stabilizing and lifting a channel board 8 by underwater grouting according to a preferred embodiment of the present invention is illustrated, which is adapted for the replacement of damaged underwater channel boards, uplift and anti-seepage reinforcement of subsided underwater channel boards, and consolidation of the gravel layer under the channel boards. The method specifically comprises the steps of:

(A) when the channel board is damaged, removing the damaged channel board, cleaning and leveling a gravel layer under the damaged channel board, placing an undamaged channel board installed with multiple first grouting pipes 7 and at least one second grouting pipe 10 on the gravel layer, wherein the multiple first grouting pipes 7 are spacedly distributed at a periphery of the undamaged channel board; the at least one second grouting pipe 10 is located at a middle portion of the undamaged channel board, multiple geotextile bags 4 are bound to a lower portion of the multiple first grouting pipes 7, respectively;

when the channel board is subsided but is undamaged due to erosion of foundation by water, drilling multiple first grouting holes 9 at a periphery of the subsided channel board and at least one second grouting hole 11 in a middle portion of the subsided channel board, and then installing multiple first grouting pipes 7 and at least one second grouting pipe 10 into the multiple first grouting holes 9 and the at least one second grouting hole 11, respectively; or when the channel board is subsided but is undamaged due to erosion of foundation by water, directly installing the multiple first grouting pipes 7 and the at least one second grouting hole 11 into the multiple first grouting holes 9 and the at least one second grouting hole 11, respectively, wherein the first grouting holes 9 and the at least one second grouting hole 11 are reserved in the subsided channel board;

(B) performing a first polymer grouting with the multiple first grouting pipes 7 for uplifting and not easily deflecting the undamaged channel board or the subsided channel board, performing a second polymer grouting with the at least one second grouting pipe 10, in such a manner that by using characteristics that the polymer 6 is able to quickly react to expand and has better cementing property, a cavity below the undamaged channel board or the subsided channel board is filled, the gravel layer is cemented with the undamaged channel board or the subsided channel board, and the undamaged channel board or the subsided channel board is lifted, so that the foundation of the undamaged channel board or the subsided channel board is stabilized and protected, wherein the polymer 6 is a non-aqueous reactive polyurethane polymer, which is able to cement in water and stabilize gravel, has expansibility, is able to lift undamaged channel board or the subsided channel board, and has anti-seepage, reinforcement, fast reaction time and an expansion factor of 1-2 times;

(C) cutting off a part of the multiple first grouting pipes 7 and the at least one second grouting pipe 10 which are exposed to the undamaged channel board or the subsided channel board with a pipe cutter, and leveling incisions; and (D) removing excess polymer left on the undamaged channel board or the subsided channel board.

Preferably, a length of each of the multiple geotextile bags 4 is the same as a height of the undamaged channel board or the subsided channel board needs to be lifted, the multiple geotextile bags 4 are located between the gravel layer and the undamaged channel board; the undamaged channel board is lifted through grouting into the multiple geotextile bags 4 and is accurately lifted through adjusting the length of the multiple geotextile bags 4, so as to further improve the stability and impermeability of the undamaged channel board or the subsided channel board.

According to the preferred embodiment of the present invention, in the step of (A), a canal structure where the undamaged channel board or the subsided channel board is located comprises canal embankment 1, sand cushion 2 with a thickness in a range of 0 to 10 cm coated on the canal embankment 1, the gravel layer 3 coated on the sand cushion 2 and the undamaged channel board or the subsided channel board 8 coated on the gravel layer in sequence, all of which are submerged in water.

Preferably, there are four first grouting holes 9 at four corners of the undamaged channel board or the subsided channel board, respectively; there is one second grouting hole 11 in the middle portion of the undamaged channel board or the subsided channel board; the four first grouting holes 9 and the second grouting hole 11 have a pore size of 5 mm for avoiding excessive drilling to cause damage to the undamaged channel board or the subsided channel board.

Preferably, the first grouting pipes 7 and the second grouting pipe 10 are stainless steel galvanized pipes, have an outer diameter of 5 mm, and are able to bend easily.

Preferably, the geotextile bags 4 are made of filament woven geotextiles and have high strength, low elongation, durability and corrosion resistance.

Preferably, in the step of (B), the first polymer grouting and the second polymer grouting are performed at a pressure in a range of 2 MPa and 5 MPa, which is convenient for control of the lifting height.

Preferably, in the step of (B), when the channel board is subsided but is undamaged, since it takes time for the polymer 6 to fully expand, it is necessary to stop and observe for a period of time after each injection, and grouting is stopped till a channel board that needs to be lifted is aligned with an adjacent channel board.

In order to verify the foregoing method for stabilizing and lifting the channel board by underwater grouting, the present invention provides a rectangular tank with a length of 1.5 m, a width of 1.5 m and a height of 0.5 m, and provides three model tests according to different working conditions.

In the first model test, a sand layer and a gravel layer are laid within the rectangular tank from bottom to top, and then water is injected into the rectangular tank for submerging the sand layer and the gravel layer; a C30 concrete slab with a length of 1.4 m, a width of 1.4 m and a thickness of 0.2 m is placed on the gravel layer, wherein there is no contact between the concrete slab and the rectangular tank, namely, the surrounding of the concrete slab is not sealed, and the concrete slab is submerged by the water; multiple grouting holes are provided in the concrete slab, multiple grouting pipes are installed into the grouting holes, respectively for grouting; after being injected into the gravel layer under the channel board, the polymer 6 rapidly reacts and expands to lift the concrete slab up about 4 cm. After lifting the concrete slab with a crane, it is found that the grout and the gravel are tightly cemented and adhered under the concrete slab, indicating that the polymer 6 is able to lift the channel board underwater and has good stability and cementation ability.

In the second model test, a sand layer and a gravel layer are laid within the rectangular tank from bottom to top, and then water is injected into the rectangular tank for submerging the sand layer and the gravel layer; a C30 concrete slab with a length of 1.4 m, a width of 1.4 m and a thickness of 0.2 m is placed on the gravel layer; a sealing material is provided between the concrete slab and the rectangular tank for filling pores therebetween to seal the surrounding of the concrete slab; a water enclosed environment is created under the concrete slab, an anhydrous environment is provided above the concrete slab; multiple grouting holes are provided in the concrete slab, multiple grouting pipes are installed into the grouting holes, respectively for grouting; after being injected into the gravel layer under the channel board, the polymer rapidly reacts and expands to lift the concrete slab up about 4 cm. After lifting the concrete slab with a crane, it is found that the grout and the gravel are tightly cemented and adhered under the concrete slab, almost all the moisture in the rectangular tank is drained and there is no moisture remained, which indicates that by utilizing the characteristics of rapid expansion, the polymer is able to remove the moisture in the gravel layer, fill the pores, implement uplift, and form a strong, stable and durable impermeable consolidation body.

In the third model test, a sand layer, a gravel layer and a concrete slab are laid within the rectangular tank from bottom to top, multiple geotextile bags with a length of 4 cm are bound with an end portion of multiple grouting pipes, the grouting pipes with the geotextile bags are installed within grouting holes which are reserved in the channel board, the grouting pipes and the channel board are fixed, the polymer is injected into the geotextile bags and rapidly expands and solidifies to fill the geotextile bags, and finally the concrete slab is lifted up by 4 cm. It shows that the underwater bagged pile lifting technology is feasible, and at the same time, geotextile bags with different lengths are able to be selected according to the lifting height. Compared with the direct grouting in the grouting holes, it is easier to accurately control the lifting.

Moreover, to verify the cementing property of the polymer in water, in the model test, a certain grade of gravels are put into a grouting mold, the grouting mold is filled with water, and then grouting is performed. During the grouting process, the slurry extrudes the water in the grouting mold from gaps thereof, and then is cemented with the gravels. After the grouting is completed, the test piece is demolded, and then the compressive strength of the consolidation body is tested by a universal testing machine. The result shows that the compressive strength exceeds 1 MPa, indicating that the polymer also has good cementing property in water.

The method provided by the present invention proposes an idea of using non-aqueous reactive polyurethane materials to repair the underwater canal structure, and proposes a technical method for rapid repair of the channel board under water conditions. The method is able to accurately lift the channel boards by adjusting the length of geotextile bags, and then grouting via the grouting hole in the middle portion of the channel board, which uses the expansion reaction characteristics of the polymer to remove the water in the gravel layer under the channel board, consolidate the gravel layer, and bond the channel board. On the one hand, the method is able to achieve anti-seepage and reinforcement of the channel board to prevent water erosion on the gravel layer and sand layer under the channel board, so as to further prevent the channel board from subsiding. On the other hand, the method is able to achieve consolidation to prevent the channel board from loosening and slipping under water erosion. Obviously, the method is able to fundamentally solve the above problems. The method is fast, efficient, and convenient in construction. Also, the grouting material used in the method is green and environmentally friendly, and has no pollution to water. Moreover, the method overcomes the shortcomings of conventional technologies that are difficult to construct underwater.

The method for stabilizing and lifting the channel board by underwater grouting is explained with specific embodiments as follows.

First Embodiment

Referring to FIGS. 1 and 3, a method for stabilizing and lifting a channel board 8 by underwater grouting according to a first preferred embodiment of the present invention is illustrated, wherein the channel board is damaged. The method specifically comprises the steps of:

(A) cleaning out silt on a surface of the damaged channel board and joint sealing materials in seams 5, removing the damaged channel board, cleaning out bonding materials on a surface of a gravel layer, leveling the gravel layer, drilling multiple first grouting holes 9 and a second grouting hole 11 which are distributed in an order shown in FIG. 3 on an undamaged channel board, binding multiple geotextile bags 4 to one end of multiple first grouting pipes 7, respectively; installing the first grouting pipes 7 with the geotextile bags 4 into the first grouting holes 9, respectively; installing a second grouting pipe 10 into the second grouting hole 11; and placing the undamaged channel board with the first grouting pipes 7 and the second grouting pipe 10 on the gravel layer, wherein the first grouting holes 9 are provided at four corners of the undamaged channel board in a diagonal form, respectively; the second grouting hole 11 is provided in a middle portion of the undamaged channel board;

(B) performing a first polymer grouting through the multiple first grouting pipes 7 with a grouting device for uplifting the undamaged channel board, and then performing a second polymer grouting through the second grouting pipe 10 with the grouting device;

(C) cutting off a part of the multiple first grouting pipes 7 and the second grouting pipe 10 which are exposed to the undamaged channel board with a pipe cutter, and leveling incisions with a file; and (D) removing excess polymer overflowing from the seams 5 on the undamaged channel board.

Second Embodiment

Referring to FIGS. 2 and 3, a method for stabilizing and lifting a channel board 8 according to a second preferred embodiment of the present invention is illustrated, wherein the channel board is subsided. The method specifically comprises the steps of:

(A) drilling multiple first grouting holes 9 and a second grouting hole 11 which are distributed in an order shown in FIG. 3 in the subsided channel board, installing multiple first grouting pipes 7 and a second grouting pipe 10 into the multiple first grouting holes 9 and the second grouting hole 11, respectively, wherein the first grouting holes 9 are provided at four corners of the subsided channel board in a diagonal form, respectively, the second grouting hole 11 is provided in a middle portion of the subsided channel board;

(B) perform a first polymer grouting through the first grouting pipes 7 with a grouting device, and performing a second polymer grouting through the second grouting pipe 10 with the grouting device, wherein since polymer slurry needs 10-20 s for complete expansion, it is necessary to stop and observe for 10 s after each injection during the first polymer grouting and the second polymer grouting, and the first polymer grouting and the second polymer grouting are stopped till the polymer slurry in the first grouting pipes 7 and the second grouting pipe 10 is level with the subsided channel board, respectively;

(C) cutting off a part of the first grouting pipes 7 and the second grouting pipe 10 which are exposed to the subsided channel board with a pipe cutter, and leveling incisions with a file; and (D) removing excess polymer overflowing from seams 5 on the subsided channel board.

Unless otherwise defined, the technical or scientific terms used herein shall have the usual meanings understood by those skilled in the art. The "first", "second" and other similar words in the specification and claims of the present application do not indicate any order, quantity or importance, but are only used to distinguish different components. Similarly, "one" and other similar words do not necessarily indicate a quantitative restriction; "include", "comprise" and other similar words indicate that the element or object appearing before the word encompasses elements or objects listed after the word and their equivalents without excluding other elements or objects; "connection" and other similar words are not limited to physical or mechanical connections, but may include electrical connections, whether direct or indirect.

The exemplary embodiments of the present invention have been described in detail above. However, those skilled in the art should understand that, without departing from the concept of the present invention, many variations and modifications are able to be made to the above specific embodiments, and various technical features and structures proposed by the present invention are able to be combined without exceeding the protection scope of the present invention.

What is claimed is:

1. A method for stabilizing and lifting a channel board by underwater grouting, wherein:

the channel board is a damaged channel board, and a gravel layer is provided under the damaged channel board;

the method comprises the steps of:

(A) removing the damaged channel board, cleaning and leveling the gravel layer under the damaged channel board, placing an undamaged channel board installed with multiple first grouting pipes and at least one second grouting pipe on the gravel layer, wherein the multiple first grouting pipes are spacedly distributed at a periphery of the undamaged channel board; the at least one second grouting pipe is located at a middle portion of the undamaged channel board, multiple geotextile bags are bound to a lower portion of the multiple first grouting pipes, respectively;

(B) performing a first polymer grouting through the multiple first grouting pipes, and then performing a second polymer grouting through the at least one second grouting pipe;

(C) cutting off a part of the multiple first grouting pipes and the at least one second grouting pipe which are exposed to the undamaged channel board with a pipe cutter, and leveling incisions; and (D) removing excess polymer left on the undamaged channel board.

2. The method according to claim 1, wherein a length of each of the multiple geotextile bags is the same as a height of the damaged channel board needs to be lifted, the multiple geotextile bags are located between the gravel layer and the undamaged channel board.

3. The method according to claim 1, wherein in the step (A), a canal structure where the undamaged channel board is located comprises canal embankment, sand cushion coated on the canal embankment, the gravel layer coated on the sand cushion and the undamaged channel board coated on the gravel layer in sequence, all of which are submerged in water.

4. The method according to claim 1, wherein there are four first grouting holes in four corners of the undamaged channel board, respectively; there is one second grouting hole in the middle portion of the undamaged channel board.

5. The method according to claim 1, wherein the first grouting pipes and the at least one second grouting pipe are stainless steel galvanized pipes.

6. The method according to claim 1, wherein the first grouting pipes and the at least one second grouting pipe have a diameter of 5 mm.

7. The method according to claim 1, wherein the polymer is a non-aqueous reactive polyurethane polymer.

8. The method according to claim 1, wherein the geotextile bags are made of filament woven geotextiles.

9. The method according to claim 1, wherein in the step (B), the first polymer grouting and the second polymer grouting are performed at a pressure in a range of 2 MPa and 5 MPa.

10. A method for stabilizing and lifting a channel board by underwater grouting, wherein:

the channel board is subsided but is undamaged;

the method comprises the steps of:

(A) installing multiple first grouting pipes and at least one second grouting pipe into multiple first grouting holes and at least one second grouting hole, respectively, wherein multiple geotextile bags are bound to a lower portion of the multiple first grouting pipes, respectively; the first grouting holes and the at least one second grouting hole are reserved or drilled on site, the multiple first grouting holes are spacedly distributed at a periphery of the subsided channel board, the at least one second grouting hole is provided at a middle portion of the subsided channel board;

(B) performing a first polymer grouting through the multiple first grouting pipes, and then performing a second polymer grouting through the at least one second grouting pipe;

(C) cutting off a part of the multiple first grouting pipes and the at least one second grouting pipe which are exposed to the subsided channel board with a pipe cutter, and leveling incisions; and (D) removing excess polymer left on the subsided channel board.

11. The method according to claim 10, wherein in the step (A), a canal structure where the subsided channel board is located comprises canal embankment, sand cushion coated on the canal embankment, a gravel layer coated on the sand cushion and the subsided channel board coated on the gravel layer in sequence, all of which are submerged in water.

12. The method according to claim 10, wherein there are four first grouting holes in four corners of the subsided channel board, respectively; there is one second grouting hole in the middle portion of the subsided channel board.

13. The method according to claim 10, wherein the first grouting pipes and the at least one second grouting pipe are stainless steel galvanized pipes.

14. The method according to claim 10, wherein the first grouting pipes and the at least one second grouting pipe have a diameter of 5 mm.

15. The method according to claim 10, wherein the polymer is a non-aqueous reactive polyurethane polymer.

16. The method according to claim 10, wherein in the step (B), the first polymer grouting and the second polymer grouting are performed at a pressure in a range of 2 MPa and 5 MPa.

17. The method according to claim 10, wherein in the step (B), observation is performed while performing the first polymer grouting and the second polymer grouting, the first polymer grouting and the second polymer grouting are stopped till the subsided channel board is aligned with an adjacent channel board.

* * * * *